US010143611B2

(12) United States Patent
Thomas

(10) Patent No.: US 10,143,611 B2
(45) Date of Patent: Dec. 4, 2018

(54) JOINT REHABILITATION APPARATUS

(71) Applicant: William N. Thomas, Nashville, TN (US)

(72) Inventor: William N. Thomas, Nashville, TN (US)

( * ) Notice: Subject to any disclaimer, the term of this patent is extended or adjusted under 35 U.S.C. 154(b) by 510 days.

(21) Appl. No.: 14/921,078

(22) Filed: Oct. 23, 2015

(65) Prior Publication Data

US 2017/0035639 A1 Feb. 9, 2017

Related U.S. Application Data

(60) Provisional application No. 62/076,984, filed on Nov. 7, 2014.

(51) Int. Cl.
*A61H 1/02* (2006.01)
*A61H 1/00* (2006.01)

(52) U.S. Cl.
CPC ..... *A61H 1/0274* (2013.01); *A61H 1/0237* (2013.01); *A61H 1/00* (2013.01); *A61H 2201/1215* (2013.01); *A61H 2201/1253* (2013.01); *A61H 2201/164* (2013.01); *A61H 2201/1614* (2013.01); *A61H 2201/1635* (2013.01)

(58) Field of Classification Search
CPC ..... A61H 1/02; A61H 1/0218; A61H 1/0237; A61H 1/024; A61H 1/0266; A61H 1/0277; A61F 5/04; A61F 5/042; A61F 5/048; A63B 21/15; A63B 21/153; A63B 21/157; A63B 21/159; A63B 21/045; A63B 21/0455; A63B 21/055–21/0557; A63B 2023/006
See application file for complete search history.

(56) References Cited

U.S. PATENT DOCUMENTS 2,280,274 A * 4/1942 Wildermuth ..... A61H 1/008 482/131
3,999,752 A * 12/1976 Kupperman ..... A63B 21/154 273/DIG. 19

(Continued)

OTHER PUBLICATIONS

DynaSplint Systems, Inc., www.dynasplint.com/joints/knee/, one page.

(Continued)

*Primary Examiner* — Michael Tsai
(74) *Attorney, Agent, or Firm* — Waller Lansden Dortch & Davis, LLP; Blake M. Bernard

(57) ABSTRACT

A rehabilitation apparatus for facilitating joint movement in a patient having a limb with a joint, the apparatus including an actuation member and an actuation strap extending from the actuation member, the actuation member selectively retracting the actuation strap, the actuation strap having a strap end engageable with the limb of the patient. A security strap is connected to the actuation member. When the limb of the patient is engaged with the strap end of the actuation strap and the actuation member retracts the actuation strap, the actuation strap produces a force on the limb. The security strap can be a harness receivable about a patient's upper torso. The apparatus can further include a brace, the joint of the patient's limb receivable in the brace, the actuation strap engageable with the brace, the actuation strap producing a force on the limb via the brace.

20 Claims, 8 Drawing Sheets

(56) References Cited

U.S. PATENT DOCUMENTS 4,456,249 A * 6/1984 Calabrese ..... A63B 21/154 482/124
4,588,186 A * 5/1986 Calabrese ..... A63B 21/154 482/131
4,606,542 A * 8/1986 Segal ..... A61F 5/0125 482/105
4,844,056 A * 7/1989 Peters ..... A61F 5/04 601/1
5,207,627 A * 5/1993 Doran ..... A61H 1/0218 482/114
5,213,094 A * 5/1993 Bonutti ..... A61F 5/0123 601/33
5,253,639 A 10/1993 Johnston
5,277,680 A * 1/1994 Johnston ..... A63B 23/03575 482/125
5,324,245 A 6/1994 Fontana et al.
5,518,486 A * 5/1996 Sheeler ..... A63B 21/0004 482/131
5,588,941 A * 12/1996 Scott ..... A61H 1/0218 482/131
6,113,564 A * 9/2000 McGuire ..... A61H 1/0229 482/131
7,896,784 B2 * 3/2011 Campbell ..... A63B 21/0023 482/907
7,955,236 B2 * 6/2011 DiGiovanni ..... A63B 21/0552 482/124
8,348,868 B1 * 1/2013 Severence ..... A61H 1/0262 601/26
8,727,950 B2 * 5/2014 Carter ..... A63B 71/0009 482/105
9,526,945 B1 * 12/2016 Edmondson ..... A63B 23/0494
2004/0049135 A1 3/2004 Callanan et al.
2005/0277527 A1 12/2005 Gregerson
2006/0053531 A1 * 3/2006 McBride ..... A41F 9/025 2/317
2006/0201450 A1 * 9/2006 Jordan ..... A01K 27/004 119/796
2007/0149368 A1 * 6/2007 Koch ..... A61H 1/024 482/131
2011/0207585 A1 * 8/2011 Burns ..... A61F 5/0123 482/124
2013/0345032 A1 * 12/2013 Aldridge ..... A61H 1/0237 482/131
2015/0148199 A1 * 5/2015 Strickland ..... A61H 1/0218 482/91

OTHER PUBLICATIONS

ERMI, inc., getmotion.com/products-and-services/knees-and-ankles, one page.
JAS—Joint Active System; jointactivesystem.com; one page.
Knee CPM's Rehab Store; http://rehabstore.com/c1471kneecpms.html; one page, Jan. 28, 2016.
International Search Report and Written Opinion, dated Jan. 26, 2017, 10 pages.

* cited by examiner

JOINT REHABILITATION APPARATUS

CROSS-REFERENCES TO RELATED APPLICATIONS

This application is a non provisional of U.S. Patent Application Ser. No. 62/076,984 filed Nov. 7, 2014 entitled JOINT REHABILITATION APPARATUS which is herein incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The current disclosure generally relates to a physical therapy apparatus for body parts and limbs. More specifically, the current disclosure relates to a rehabilitation apparatus used to facilitate joint movement in a physical therapy patient using the apparatus, the patient having a limb with a joint.

It is common medical practice to have corrective surgery for joints, such as knee and elbow joints. After such surgeries, the patient typically goes through a period of rehabilitation in which the patient has some period of healing associated with the surgery followed by a period of a specific planned movement for that joint. This process is typically referred to as a physical therapy treatment following a surgical procedure.

This is especially true when the surgery involves the joint of a limb, such as the knee of the leg or elbow of the arm. The focus of this physical therapy is to return as much of the range of motion of the joint as possible following the surgery. The typical physical therapist will want to move the joint to and from a fully extended and a fully bent position as much as possible given the medical procedure performed. Additionally, throughout this physical therapy treatment that range of motion will increase as the patient participates in the physical therapy sessions.

Additional features of physical therapy processes are exercises, or range of motion procedures, that the patient can perform by himself or herself between the physical therapy sessions at home without direct medical supervision. These range of motion procedures are also designed to increase the flexibility and/or strength of a joint post-operation.

There are currently numerous physical therapy devices that can help facilitate these physical therapy sessions and the range of motion movements used therein. For example, U.S. Pat. Nos. 4,089,330, 5,020,795, 5,324,245, and 8,784,343, and United States Patent Application Publication Numbers 2013/0345032, 2014/0088466, 2014/0094721, 2014/0200490, and 2014/0228186 are directed at physical therapy devices.

However, these devices include large, heavy equipment, many of which are only suitable for a medical office, such as a doctor's or a physical therapist's office. Additionally, it is difficult and cumbersome for a patient to move or transport many of these devices because of their size, weight, and complexity. The complexity of some of these devices also make them inappropriate for use absent medical supervision. As such, while physical therapy devices may exist that are effective to facilitate joint movement in a limb, such devices lack portability and are not suitable for at home or personal use.

Additionally, many patients are prone to frequent travel away from home. Large, heavy, and complicated physical therapy devices are not conducive for traveling, and patient's often have to either carry such cumbersome physical therapy equipment with them when they travel, or choose to forego physical therapy during their travels, both options being generally undesirable. Often patient's will choose to forego their treatments, which can set back the progress of the physical therapy treatment.

What is needed then are improvements to physical therapy apparatuses for facilitating joint movement.

BRIEF SUMMARY OF THE DISCLOSURE

One aspect of the present disclosure is a rehabilitation apparatus for facilitating joint movement in a patient having a limb with a joint, the apparatus including an actuation member and an actuation strap extending from the actuation member, the actuation member selectively retracting the actuation strap, the actuation strap having a strap end engageable with at least a portion of the limb of a patient. A security strap can be connected to the actuation member. When the limb of the patient is engaged with the strap end of the actuation strap and the actuation member retracts the actuation strap, the actuation strap produces a force on the limb. In some embodiments, the actuation member can include a collection area, and the actuation member can selectively retract the actuation strap into the collection area.

In some embodiments, the security strap can be a harness that can be received about a patient's upper torso. As such, the apparatus can be secured directly to the patient's body, the actuation strap can engage the patient's limb, and the user can actuate the actuation member to retract the actuation strap to produce a force on the patient's limb in order to facilitate joint movement in the limb. In some embodiments, the force can bias the patient's limb toward a bent position. In other embodiments, the force can bias the patient's limb toward a straightened position.

In some embodiments, the apparatus can include a brace positionable on the joint of the limb such that joint is received in the brace. The actuation strap can engage or be positioned on the brace during use of the apparatus such that the actuation strap produces a force on the limb via the brace when the actuation member selectively retracts the actuation strap. In such an embodiment, the brace can allow a force to be applied to the limb such that the limb is biased toward a straightened position.

One objective of the present disclosure is to provide an effective joint rehabilitation apparatus which can facilitate joint movement in a patient's limb.

Another objective is to provide a joint rehabilitation apparatus that is portable or capable of being transported or moved with relative ease.

Another objective is to provide a joint rehabilitation apparatus that can promote both bending and straightening of the joint.

Another objective is to provide a joint rehabilitation apparatus for a patient's knee or elbow joint.

Other objectives, features and advantages of the present disclosure will be readily apparent to those skilled in the art upon reading of the following disclosure when taken in conjunction with the accompanying drawings.

DETAILED DESCRIPTION OF THE DISCLOSURE

Figure 1:
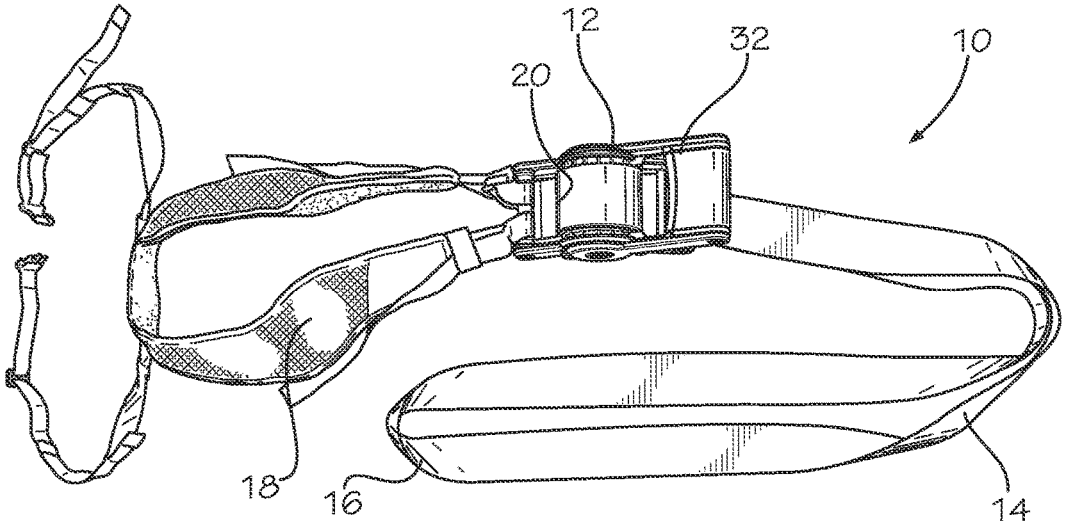
FIG. 1 is a perspective view of an embodiment of a rehabilitation apparatus of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

An embodiment of a joint rehabilitation apparatus 10 for facilitating joint movement in a patient having a limb with a joint is shown in FIG. 1. The apparatus 10 includes an actuation member 12. An actuation strap 14 extends from actuation member 12. Actuation member 12 can selectively retract actuation strap 14, actuation strap 14 having a strap end 16 that is engageable with at least a portion of a limb of a patient. Apparatus 10 can also include a security strap 18 which can be connected to actuation member 12. When the limb of a patient is engaged with strap end 16 of actuation strap 14 and actuation member 12 retracts actuation strap 14, actuation strap 14 can produce a force on the limb which can facilitate movement of the limb at a joint. As actuation strap 14 is retracted into actuation member 12, the force on the limb can help bias the limb to move at the joint.

Figure 2:
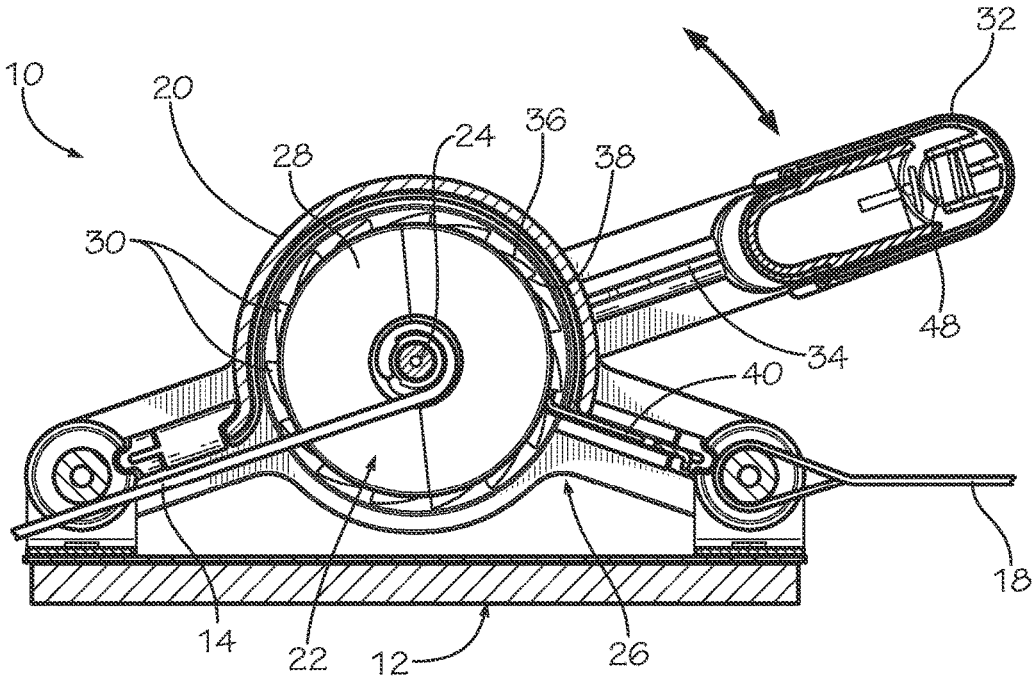
FIG. 2 is a side cross sectional view of an actuation member of the apparatus of FIG. 1.
Figure 3:
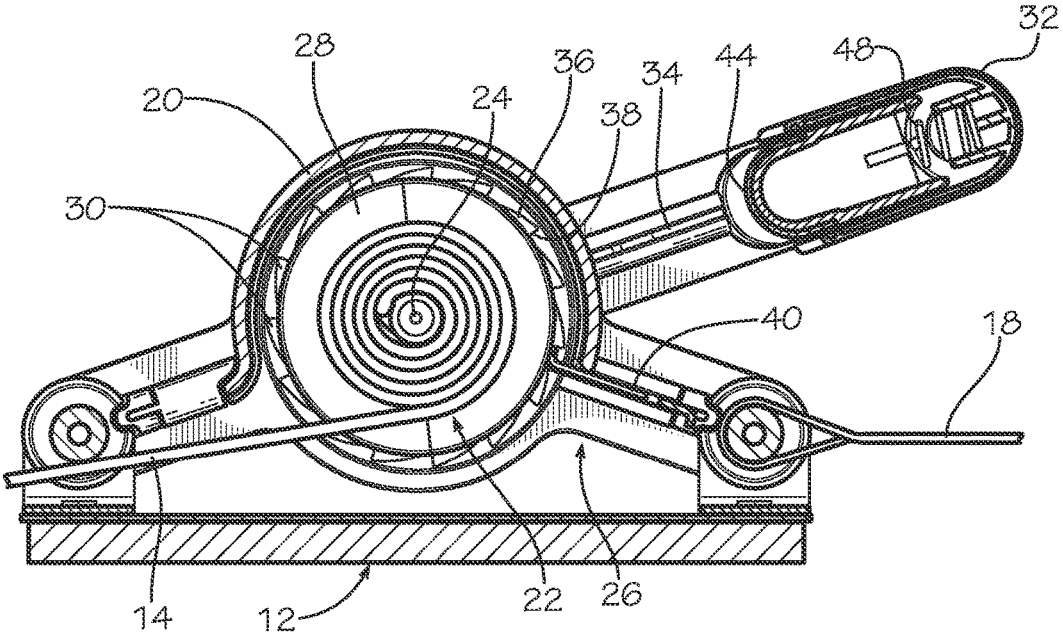
FIG. 3 is a side cross sectional view of the actuation member of FIG. 1 with an actuation strap retracted within the actuation member.

A cross section view of actuation member 12 of FIG. 1 is shown in FIG. 2 and FIG. 3. In some embodiments, actuation member 12 can include an outer housing 20 and a collection area 22 at least partially defined in outer housing 20. In such embodiments, when actuation member 12 retracts actuation strap 14 into actuation member 12, actuation strap 14 can be retracted into collection area 22. In some embodiments, actuation member 12 can include a spool 24 located in collection area 22, such that actuation strap 14 winds around spool 24 as actuation member 12 retracts actuation strap 14, and actuation strap 14 can thereby be collected within collection area 22.

As can be seen in FIGS. 2 and 3, in some embodiments, actuation member 12 can include a pawl and ratchet system 26. Pawl and ratchet system 26 can include a gear 28 having a plurality of ratchet teeth 30. The gear 28 can be rotationally disposed in outer housing 20 within collection area 22. Spool 24 in some embodiments can be connected or integrally formed on gear 28 such that as gear 28 rotates, spool 24 is thereby rotated. In such embodiments, actuation strap 14 can engage spool 24 such that as gear 28 in actuation member 12 is rotated, actuation strap 14 can wind about spool 24 such that actuation strap 14 retracts into actuation member 12.

Actuation member 12 can include an actuation handle 32 which can be rotatably connected to outer housing 20. Pawl and ratchet system 26 can further include a first pawl 34 positioned on actuation handle 32. First pawl 34 can be biased on actuation handle 32 to engage ratchet teeth 30 on gear 28. Each ratchet tooth in the plurality of ratchet teeth 30 can include a first angled side 36 and a second substantially flat side 38. In FIG. 2, as actuation handle 32 is rotated about outer housing 20 in a counter-clockwise fashion towards actuation strap 14, first pawl 34 engages a second substantially flat side 38 of one of the ratchet teeth 30 such that as actuation handle 32 is turned, first pawl 34 forces gear 28 to turn, thereby causing actuation strap 14 to wind about spool 24. As such, actuation member 12 effectively retracts actuation strap 14 with each turn of actuation handle 32.

Pawl and ratchet system 26 can also include a second pawl 40 positioned on actuation member 12, second pawl 40 can also be biased to engage ratchet teeth 30. As actuation handle 32 turns gear 28 to retract actuation strap 14, second pawl 40 slides over first angled sides 36 of ratchet teeth 30, which allows gear 28 to be turned by actuation handle 32 and first pawl 34 in a counterclockwise direction. As actuation handle 32 is subsequently rotated in a clockwise fashion away from actuation strap 14, second pawl 40 engages a second substantially flat side 38 of one of ratchet teeth 30 to prevent gear 28 from rotating in a clockwise direction, which thereby prevents actuation strap 14 from uncoiling or loosening. Preventing actuation strap 14 from loosening can help ensure that the patient's limb is maintained or biased in a desired position or degree of movement. First pawl 34 can slide over first angled sides 36 of ratchet teeth 30 until actuation handle 32 is returned to its starting position. This process can be repeated to further retract actuation strap 14 into actuation member 12 as desired, with actuation strap 14 effectively winding about spool 24 as shown in FIG. 3. While one orientation of the pawl and ratchet system is shown in FIGS. 2 and 3, one of skill in the art would recognize that the orientation of actuation handle 32, first and second pawls 34 and 40, and ratchet teeth 30 on actuation member 12 could be mirrored to produce substantially the same ratcheting effect on actuation strap 14.

In some embodiments, actuation member 12 can include a single gear 28, and first and second pawls 34 and 40 can each selectively engage gear 28. In other embodiments, actuation member 12 can include two gears 28 on either end of spool 24, and first pawl 34 can selectively engage one gear 28 while second pawl 40 selectively engages the other gear 28. In still further embodiments where actuation member 12 includes two gears 28, first pawl 34 can include a first set of pawl arms, each arm in the first set of pawl arms engaging a respective gear 28, and second pawl 40 can include a second set of pawl arms, each arm in the second set of pawl arms engaging a respective gear 28. In such an embodiment, actuation force from actuation handle 32 and first pawl 34 can be applied to both gears 28 on each end of spool 24 such that a balanced force is applied across spool 24. Similarly, retention forces applied by second pawl 40 to help prevent actuation strap 14 from loosening can be applied to both ends of spool 24 such that a balanced retention force is applied across spool 24.

Figure 4:
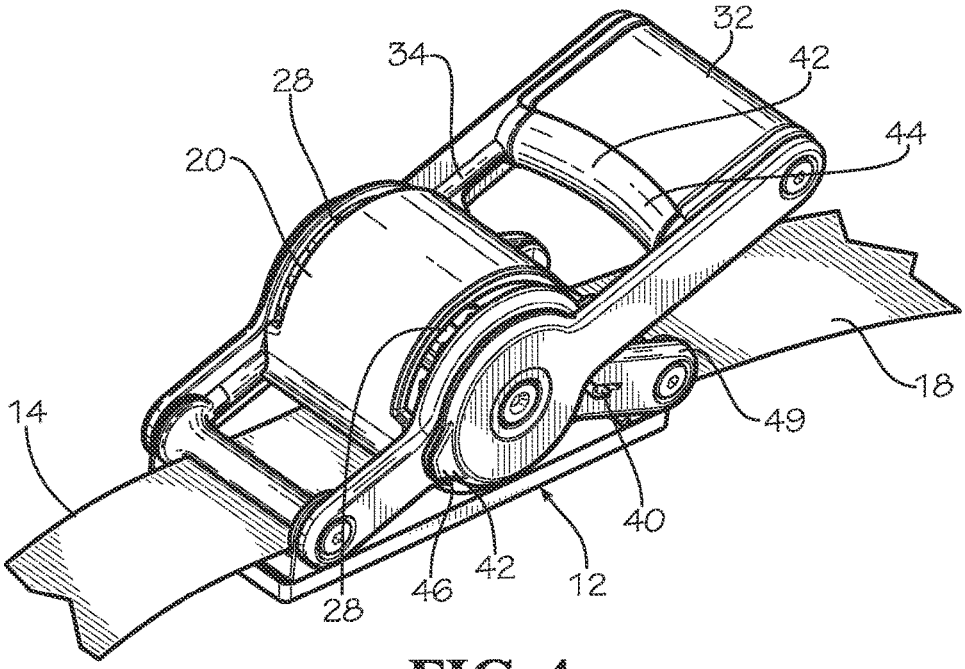
FIG. 4 is a side perspective view of the actuation member of FIG. 1.

Actuation member 12 can also include a release mechanism 42, shown in FIGS. 3 and 4. When release mechanism 42 is engaged, actuation strap 14 can be extended, released, or loosened from actuation member 12. In some embodiments, release mechanism 42 can include a first release member 44 configured to selectively release first pawl 34 from engagement with ratchet teeth 30, and a second release member 46 can be configured to selectively release second pawl 40 from engagement with ratchet teeth 30. First release member 44 in some embodiments can be a push button connected to first pawl 34. Push button 44 can be biased by a spring 48 or other suitable biasing member on actuation handle 32, spring 48 biasing first pawl 34 to engage ratchet teeth 30. When push button 44 is depressed, first pawl 34 is retracted such that first pawl 34 is disengaged with ratchet teeth 30.

Second release member 46 can be configured to selectively release second pawl 40 from engagement with ratchet teeth 30. In some embodiments, second pawl 40 can be slidably disposed on an actuation member leg 49 extending from outer housing 20, second pawl 40 biased to engage ratchet teeth 30. In such embodiments, second release member 46 can be a protrusion extending from actuation handle 32. Second release member 46 can be positioned on actuation handle 32 proximate the connection between actuation handle 32 and outer housing 20. As actuation handle 32 is rotated in a counter clockwise fashion in FIG. 4, second release member 46 can be oriented to engage second pawl 40, second release member 46 forcing second pawl 40 to retract and disengage from gear 28.

As such, when actuation handle 32 is in a position such that second release member 46 disengages second pawl 40 from ratchet teeth 30, and push button 44 on actuation handle 32 is depressed which disengages first pawl 34 from ratchet teeth 30, gear 28 can be free to rotate in a clockwise direction in FIG. 3 by pulling actuation strap 14 away from actuation member 12. Actuation strap 14 can therefore be unwound from spool 24 to produce slack in the actuation strap 14 when the physical therapy is over and is subsequently repeated.

Actuation member 12 shown in FIGS. 2-4 includes a pawl and ratchet system. However, actuation member 12 can be any suitable device for selectively retracting actuation strap 14. For instance, in some embodiments, actuation member can be an electric winch including a motor which can wind actuation strap 12 into actuation member 12 automatically. Actuation member 12 can include a controller which can allow a patient user to control the retraction of actuation strap 14 via a switch or other suitable mechanism. In other embodiments, the controller can be preprogrammed to retract actuation strap 14 a predetermined distance upon a command input from the patient.

Security strap 18, as shown in FIGS. 1-3, can be connected to actuation member 12. Security strap 18 in some embodiments can be secured to a counter balancing member such as a table, chair, post, column, etc., or the patient or user's body, such that security strap 18 can provide a counter-balancing force to actuation member 12 as actuation member 12 is actuated and retracts actuation strap 14. Security strap 18 can help prevent actuation member 12 from moving during use of apparatus 10, such that as actuation strap 14 is retracted into actuation member 12, force can effectively be transferred from actuation strap 14 to a patient's limb. In some embodiments, security strap can generally extend from actuation member 12 opposite of actuation strap 14, such that when apparatus 10 is in use and security strap 18 is secured to a counterbalancing member, security strap 18 can produce a force on actuation member 12 in the opposite direction from the force applied by the limb of the patient on actuation member 12 via actuation strap 14.

Figure 6:
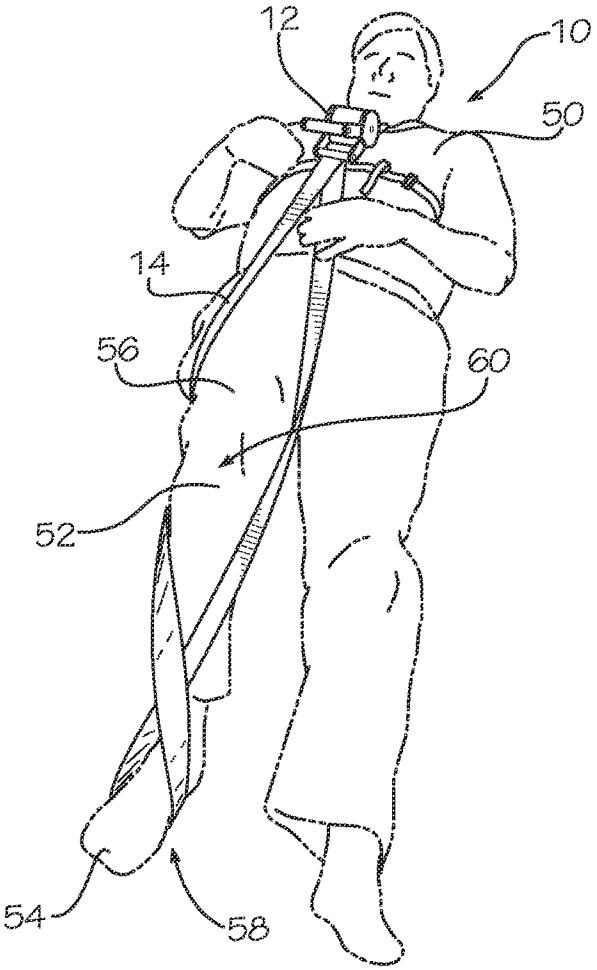
FIG. 6 is a perspective view of a patient using the apparatus of FIG. 1 with the patient's limb engaged with a strap end of the actuation strap.
Figure 5:
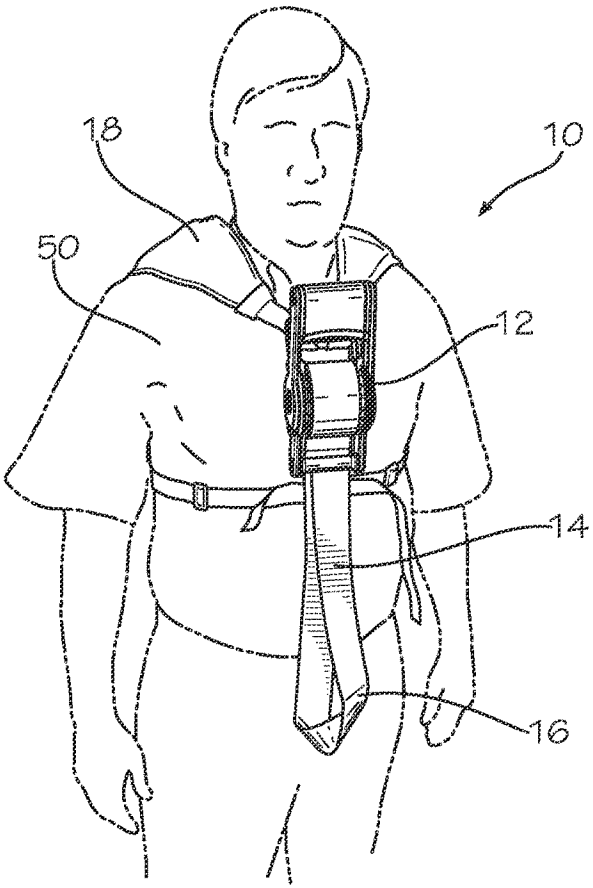
FIG. 5 is a perspective view of a security strap of the apparatus of FIG. 1 being received above a patient's upper torso.

In some embodiments, as shown in FIGS. 5 and 6, security strap 18 can be a harness which is receivable about a patient's upper torso 50. Harness 18 in some embodiments can extend over the shoulders and around the back of a patient to help stabilize actuation member 12 on the patient's body or upper torso 50. Strap end 16 of actuation strap 14 can then engage a patient's limb, and actuation member 12 can be actuated in order to perform the desired physical therapy treatment.

In some embodiments, strap end 16 can include a loop which can be sized to receive at least a portion of the patient's limb. For example, in some embodiments, the patient's limb is a leg 52 having a foot 54 and a knee joint 56, and the loop of strap end 16 is sized to receive and engage the patient's foot 54, as shown in FIG. 6. As actuation member 12 is actuated and actuation strap 14 is retracted into actuation member 12, actuation strap 14 produces a force on the leg 52 via the foot 54, the force effective to bias leg 52 to move at knee joint 56. In other embodiments, the limb can be an arm having a hand and an elbow joint. Strap end 16 can be sized to receive the hand of the patient, and as actuation strap 14 produces a force on the hand as actuation member 12 retracts actuation strap 14, the force on the hand can be effective to bias the arm to move at the elbow joint.

In some embodiments, actuation strap 14 can be a single strap extending from actuation member 12, actuation strap 14 having a looped strap end 16. In other embodiments, as shown in FIG. 6, actuation strap 14 can have a double strap configuration, such that actuation strap 14 is one large loop extending from actuation member 12, and strap end 16 is defined as the apex or turn of the loop. In such an embodiment, as the patient engages actuation strap 14 with the patient's limb, actuation strap 14 can be twisted such that a first smaller loop 58 is formed which can receive the foot 54 or hand of the patient, and a second larger loop 60 can be formed which can receive the knee joint 56 or the elbow joint, depending on what limb on which apparatus 10 is being utilized. As such, during use, actuation strap 14 can stabilized both the distal end of the limb as well as the joint, as actuation strap 14 passes on either side of the joint. Actuation strap 14 can therefore act as a guide for movement of the limb. While actuation strap 14 is shown in FIG. 6 as a continuous looped strap, in other embodiments actuation strap 14 can include multiple straps that can be fastened together around a patient's limb, actuation strap 14 including any suitable fastener including hook and loop fasteners, buckles, clasps, snaps, etc.

As can be seen from FIG. 6, apparatus 10 can be secured to the patient's body and used without the necessity of additional equipment such as tables, chairs, benches, or other complex equipment. As such, apparatus 10 can be portable and easy to move or transport as apparatus 10 can be used without large, heavy, or complicated machinery that is difficult to carry. The portability of apparatus 10 can be beneficial to those patient's that travel often or spend significant amounts of time away from home. Apparatus 10 can be easily stored in a suitcase, backpack, travel case, etc. such that a patient can take apparatus 10 with them when they travel and the patient's physical therapy can continue even when the patient is away from home. Furthermore, because of the portability and compactness of apparatus 10, apparatus 10 can be quickly stored when not in use without consuming a substantial amount of space.

Additionally, in one previously described use of apparatus 10, the patient can simply lie or sit down as appropriate and connect apparatus 10 about his torso 50 and the desired limb as previously described and subsequently perform the physical therapy treatment. As such, apparatus 10 can be used where there is enough space for the patient to lie down or sit down, and therefore apparatus 10 does not require a large amount of space in order to operate. As such, apparatus 10 can be used with relative ease in a variety of locations, including at the home, office, hotel, etc. of the patient.

Figure 7:
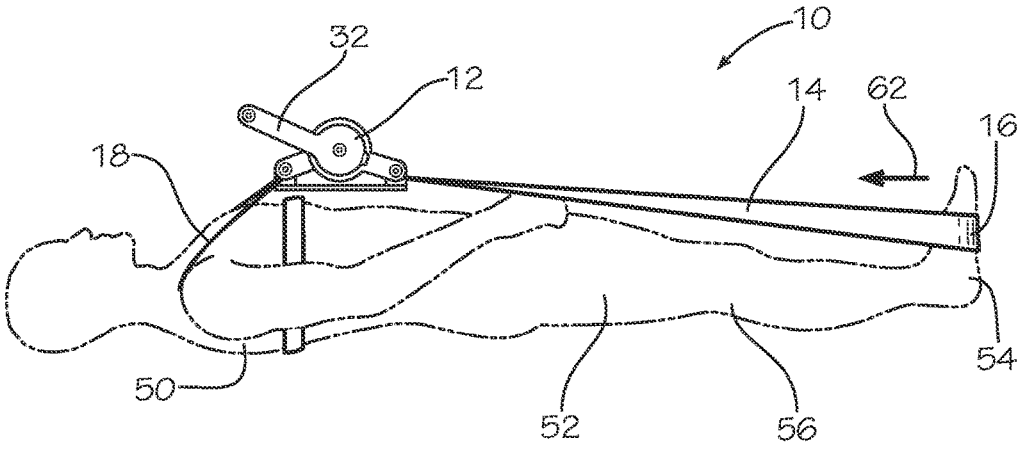
FIG. 7 is a side view of a patient using the apparatus of FIG. 1 with the patient's limb in an initial unbent position.
Figure 8:
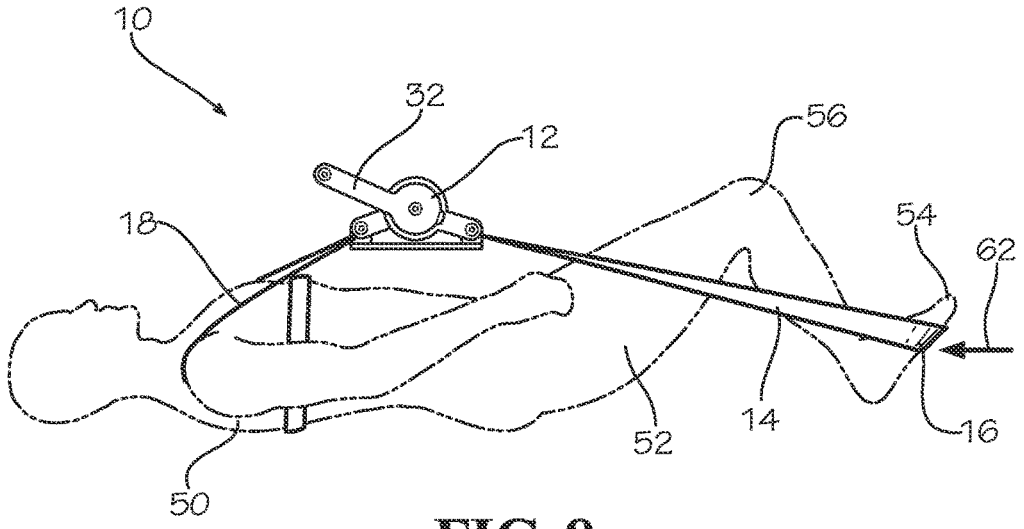
FIG. 8 is a side view of a patient using the apparatus of FIG. 1 with the actuation strap retracted by the actuation member and the actuation strap biasing the patient's limb toward a bent position.

A first type of physical therapy treatment is shown in FIGS. 7 and 8, wherein the force 62 produced on the limb via actuation strap 14 biases the limb toward a bent position, as shown in FIG. 8. The limb in FIG. 8 is a leg 52, with actuation strap 14 engaging the foot 54 of leg 52. As actuation strap 14 is retracted into actuation member 12, actuation strap 14 produces a force 62 on foot 52 that pulls foot 54 toward the patient's upper torso 50. As such, force 62 biases knee joint 56 and leg 52 to move toward a bent position. As actuation member 12 continues to retract actuation strap 14, knee joint 56 can bend further to a desired degree of movement. A similar therapy could be used when the limb is an arm, actuation strap 14 producing an inward force on the arm, the force biasing the arm to bend at the elbow.

Figure 9:
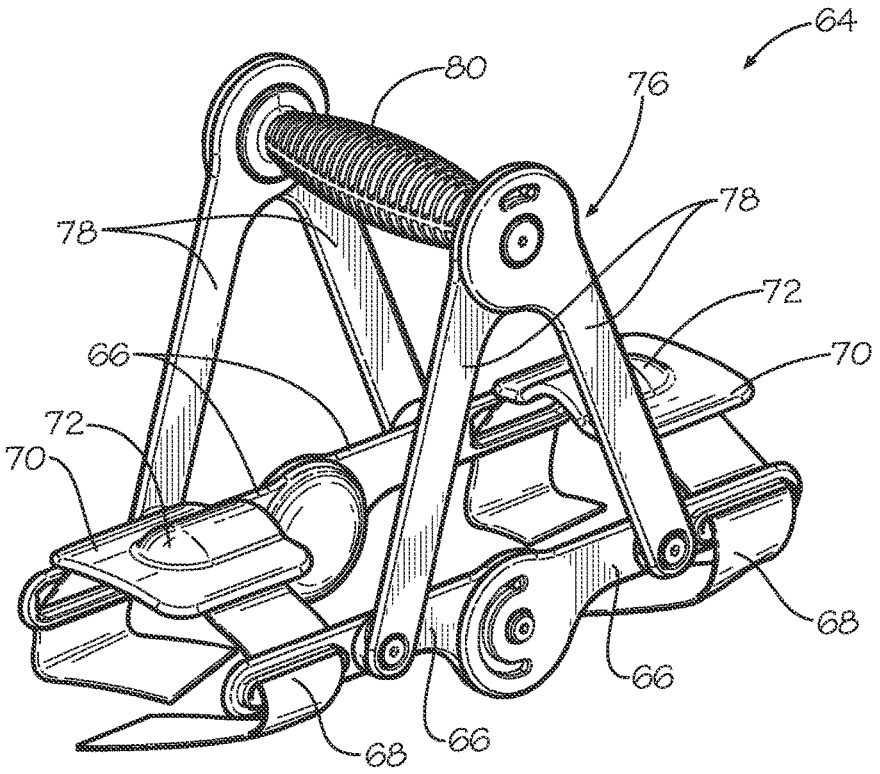
FIG. 9 is a perspective view of an embodiment of a brace that can be further included with the apparatus of FIG. 1.
Figure 10:
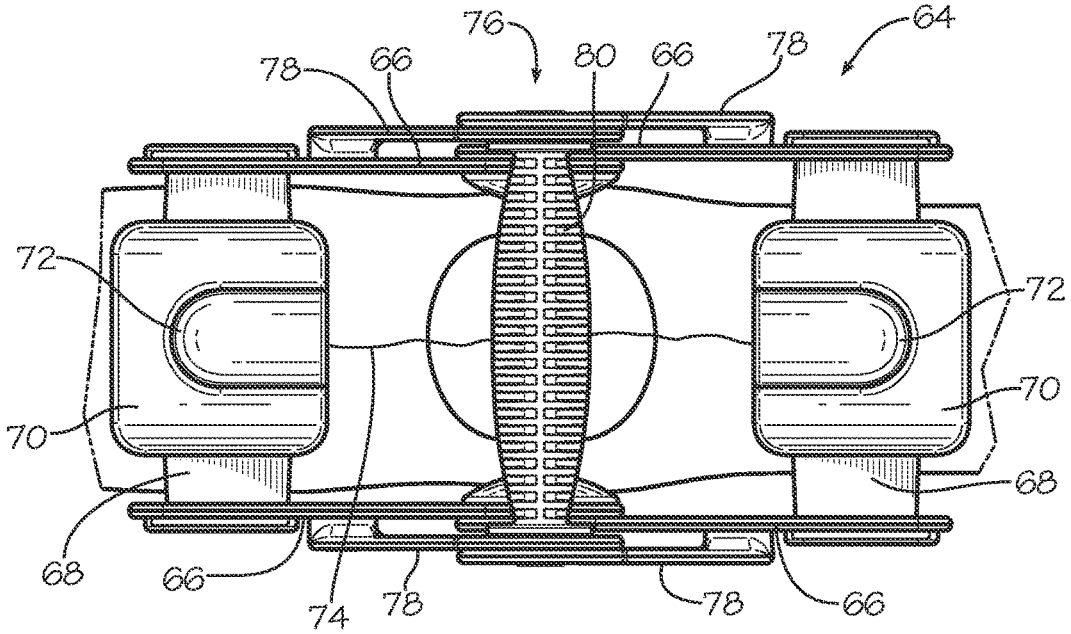
FIG. 10 is a top view of the brace of FIG. 9 positioned on a joint of a patient's limb.
Figure 11:
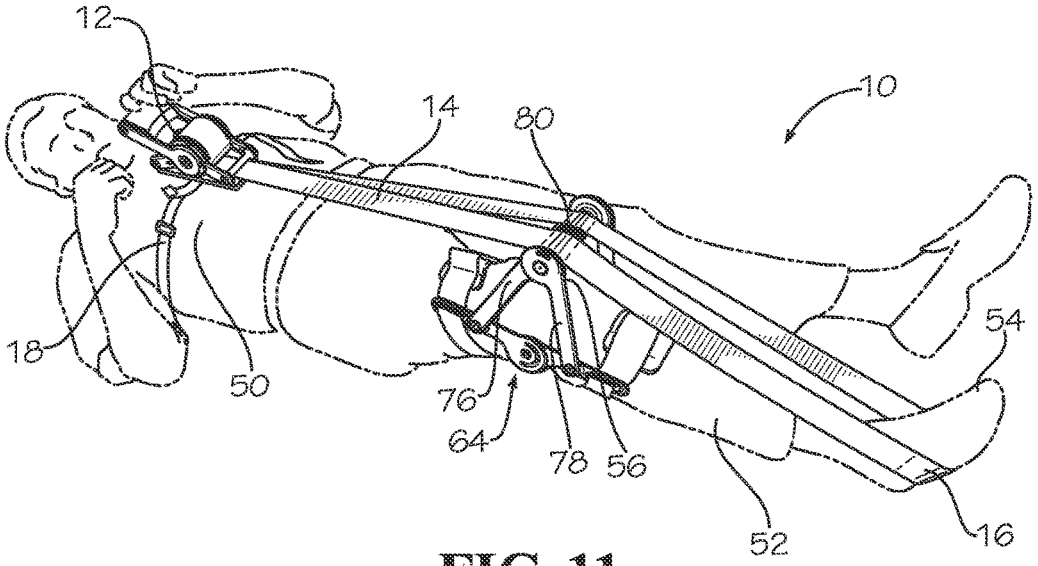
FIG. 11 is a side perspective view of a patient using the apparatus of FIG. 1 including the brace of FIG. 9.

An embodiment of a brace 64 that can be used with apparatus 10 of FIG. 1 is shown in FIG. 9-11. The joint of the limb of the patient can be received in brace 64 such that brace 64 can be positioned about the joint. Actuation strap 14 can be positioned on brace 64, or brace 64 can engage actuation strap 14, when the patient's joint is received in brace 64 and the patient's limb is received in strap end 16 of actuation strap 14. As such, as actuation member 12 retracts actuation strap 14, actuation strap 14 can produce a force on the limb of the patient via brace 64.

Brace 64 can include one or more pairs of support arms 66 that can extend alongside the limb and the joint of the patient when the joint of the patient is received in brace 64. One or more brace straps 68 can be used to secure support arms 66 to the patient's limb about the joint. Each pair of support arms 66 can be pivotally connected to one another such that as the limb of the patient moves during therapy, support arms 66 can pivot with respect to one another to accommodate the movement of the patient's limb.

In some embodiments, brace 64 can include one or more pads 70 positionable about the joint of the patient. Brace straps 68 can engage both support arms 66 and pads 70 when securing brace 64 to the patient's limb. In some embodiments, each pad 70 can include a raised central portion 72. Typical after joint surgery, a scar 74 is produced that spans the joint. Raised central portions 72 allow pads 70 and straps 68 to be positioned about the joint of the patient's limb while helping to reduce the stresses or forces to the area adjacent the scar 74, which can help prevent tearing or opening up of the wound during the physical therapy treatment.

In some embodiments, brace 64 can include an extension member 76 which can extend from brace 64 in an outward direction from the limb of the patient when the limb is received by brace 64. Extension member 76 in some embodiments can include one or more extension member legs 78 positioned on either side of the patient's limb when the limb is received by brace 64, and a crossbar 80 extending between the extension member legs 78. In other embodiments, as shown in FIG. 9, extension member 76 can include multiple pairs of extension member legs 78, a pair extending on either side of the patient's limb when the limb is received in the brace. The crossbar 80 can extend between the pairs of extension member legs. Each pair of extension member legs 78 can be pivotally connected together, and each extension member leg can also be pivotally connected to a corresponding support arm 66 of brace 66. As such, as a limb received in brace 64 moves at the joint, support arms 66 and extension member legs 78 are allowed to pivot and move relative to one another to allow movement of the limb during the physical therapy treatment.

Figure 12:
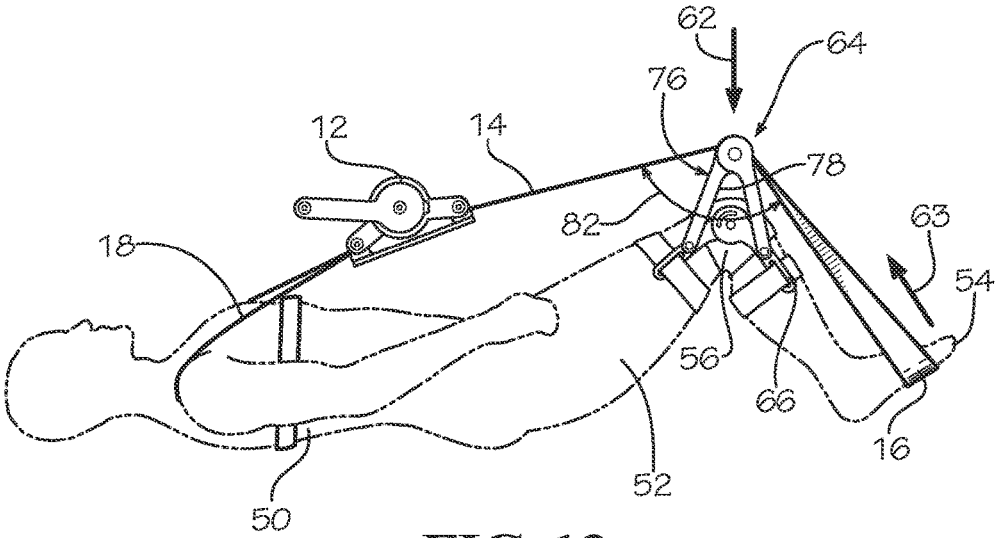
FIG. 12 is a side view of a patient using the apparatus of FIG. 11 with the patient's limb in an initially bent position.
Figure 13:
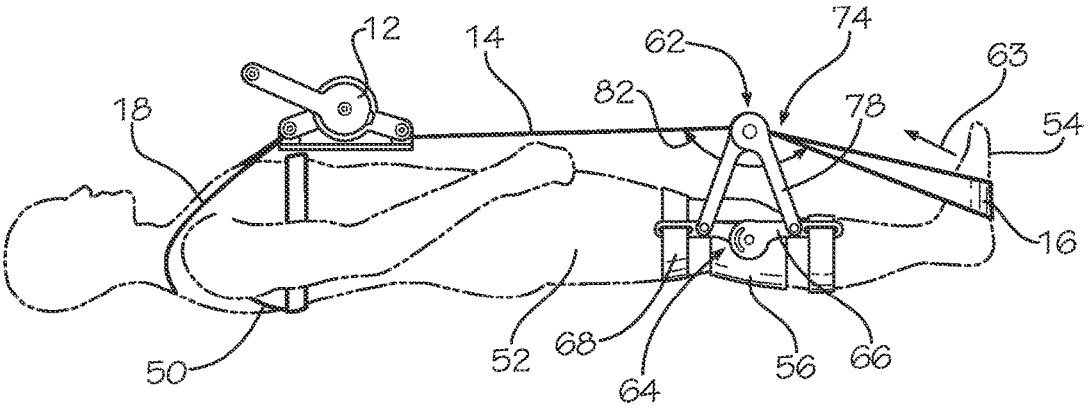
FIG. 13 is a side view of a patient using the apparatus of FIG. 11 with the actuation strap retracted by the actuation member and the actuation strap biasing the patient's limb toward a straightened position.

In such embodiments, actuation strap 14 can be engageable with extension member 76 of brace 64, and in some embodiments with crossbar 80 of extension member 76, when strap end 16 of actuation strap 14 is engaged with the limb of the patient as shown in FIGS. 11 and 12. Extension member 76 can be engageable with actuation strap 14 at a point on actuation strap 14 between strap end 16 and actuation member 12. Extension member 76 can produce an angle 82 between 0 and 180 degrees in actuation strap 14, as shown in FIGS. 12 and 13. As such, when actuation strap 14 is retracted into actuation member 12, the angle 82 of actuation strap 14 can cause actuation strap 14 to produce a force 62 on the patient's limb via the brace 64 that can bias the limb towards a straightened position.

For instance, a second type of physical therapy is shown in FIGS. 12 and 13. In some embodiments, the patient's limb is a leg 52 with a foot 54 and a knee joint 56. Knee joint 56 can be receivable in brace 64, and foot 54 can be receivable in strap end 16 of actuation strap 14. Actuation strap 14 can then be positioned on extension member 76 of brace 64.

When actuation member 12 retracts actuation strap 14, actuation strap 14 produces a force on extension member 76 of brace 64 oriented in a direction toward knee joint 56. When the patient is lying down to perform the physical therapy treatment, as shown in FIGS. 12 and 13, actuation strap 14 can produce a downward force 62 on knee joint 56 which can bias knee joint 56 and leg 52 toward a straightened position. Additionally, with knee joint 56 bent and actuation strap 14 angled upward with respect to foot 54, as actuation strap 14 is retracted by actuation member 12, actuation strap can also produce an second upward force 63 on foot 54, w which further biases leg 52 toward a straightened position. A similar therapy can be performed when the limb is an arm with a hand and an elbow joint, brace 64 being received about the elbow joint, and the force produced on the arm by actuation strap 14 via brace 64 biasing the elbow joint and the arm toward a straightened position.

Extension member 76 can be dimensioned to extend outward from the patient's leg 52 such that even when leg 52 is straight, as shown in FIG. 13, extension member 76 produces an angle 82 in actuation strap 76. Continuously having an angle 82 defined in actuation strap 14 during the physical therapy treatment can help ensure that force 62 on brace 64 is continuously applied such that force 62 can continuously bias the patient's limb toward a straightened position. If actuation strap 14 were allowed to straighten and angle 82 was allowed to become 180 degrees, then actuation strap 14 would cease to apply a force 62 on brace 64.

As such, apparatus 10 can be used to facilitate bending of the joint of the patient when brace 64 is not positioned on the joint. By placing brace 64 on the joint, straightening of the joint can also be facilitated. As such, apparatus 10 can be used to facilitate both bending and straightening of the joint for physical therapy purposes.

Figure 14:
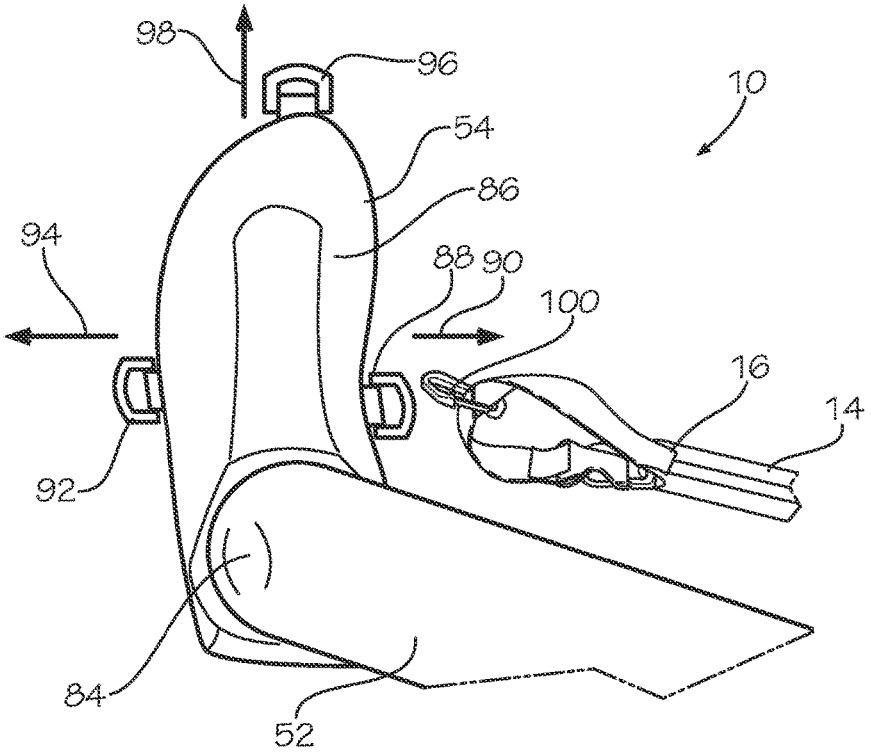
FIG. 14 is a perspective view of an embodiment of a foot device that can be further included in the apparatus of FIG. 1 to facilitate movement of an ankle joint.

In some embodiments, as shown in FIG. 14, the limb of the patient can be a leg 52 having a foot 54 and an ankle joint 84, and apparatus 10 can be used to facilitate movement in ankle joint 84. In such embodiments, apparatus 10 can further include a foot device 86 which is securable to foot 52 of the patient. Foot device 86 can have a first fastener member 88 extending in a laterally inward direction 90 from foot device 86. Foot device 86 can also have a second fastener member 92 extending in a laterally outward direction from foot device 86. Foot device 86 can further have a third fastener member 96 extending in a longitudinally outward direction 98 from foot device 86. Actuation strap 86 can be engageable with either the first, second or third fastener member 88, 92, and 96.

In some embodiments, foot device 86 can be any suitable structure that can receive a patient's foot, including, but not limited to, a shoe, sock, boot, sandal, or a plurality of straps positioned about the patient's foot. Fastener members 88, 92, and 96 can be any suitable fastening structure, including rings, catches, hooks, buttons, hook and loop fasteners, buckles, clasps, etc. In FIG. 14, tfastener members 88, 92, and 96 are shown as rings or loops extending from foot device 86. Actuation strap 14 can also include a hook 100, or any other suitable structure, to engage fastener members 88, 92, and 96.

Foot device 86 can be used to facilitate movement of ankle joint 84 of a patient's leg 52. When actuation strap 14 engages first, second, or third fastener members 88, 92, and 96, and actuation member 12 retracts actuation strap 14, forces can be applied to foot 54 via foot device 86 at different angles in order to bias foot 52 to move about ankle joint 84 in varying directions. For instance, if force is applied to first fastener member 88, then foot 56 can be biased to supinate or cause inversion of ankle joint 84. If force is applied to second fastener member 92, then foot 54 can be biased to pronate or cause eversion of ankle joint 84. If force is applied to third fastener member 96, the foot 52 can be biased to flex or cause dorsiflexion of ankle joint 84. As such, foot device 86 can be used to produce varying therapeutic movements of an ankle joint 84 of a patient.

Figure 15:
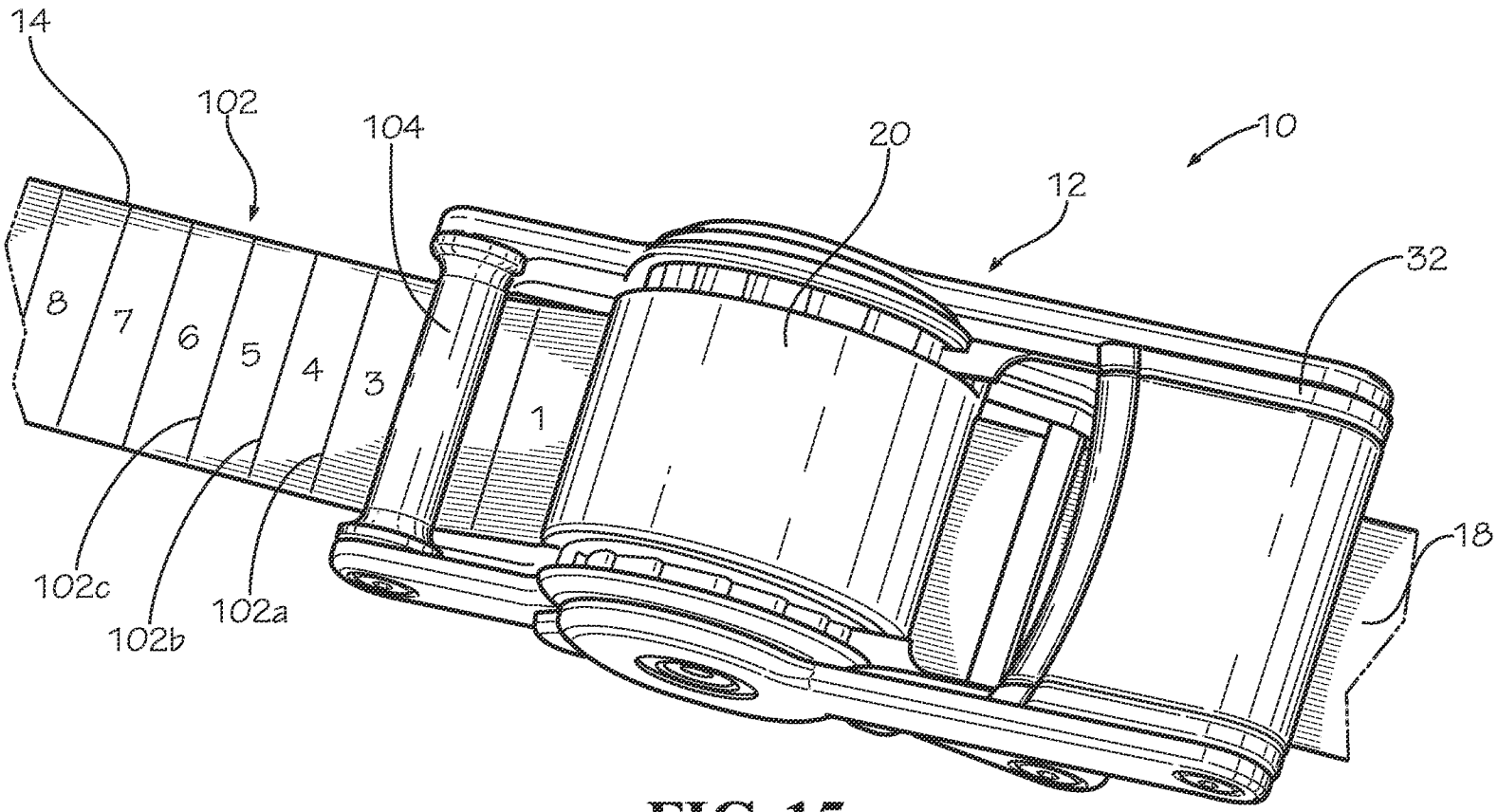
FIG. 15 is a detailed view of an embodiment of an actuation strap which includes a plurality of guide markings.

In some embodiments, as shown in FIG. 15, actuation strap 14 can include a plurality of guide markings 102. Guide markings 102 can be used by a treating physician or physical therapist to provide a treatment plan for the patient to perform at home. For instance, for a first proscribed time period, the patient could retract actuation strap 14 until a first marking 102*a* reaches an actuation strap guide 104 on actuation member 12. In a second proscribed time period as movement in the joint increases, the patient could retract actuation strap 14 until second marking 102*b* reaches actuation strap guide 104. In a third proscribed time period as movement in the joint further increases, the patient could retract actuation strap 14 until a third marking 102*c* reaches actuation strap guide 104, and so forth. As such, guide markings 102 can allow a physician to establish a treatment plan for the patient which can be tailored to the patient's size and needs, and guide markings 102 can help the patient readily apply a more consistent and regimented physical therapy treatment to the joint at home.

Another aspect of the present disclosure is a method of facilitating movement in a joint of a limb of a patient. The method can include providing an apparatus having an actuation member, an actuation strap extending from the actuation member, the actuation member selectively retracting the actuation strap, and a security strap connected to the actuation member; providing a counterbalancing member; securing the security strap to the counterbalancing member; engaging the actuation strap with the patient's limb; and retracting the actuation strap with the actuation member, the actuation strap producing a force on the limb to facilitate movement of the limb. In some embodiments, the force produced on the actuation strap can bias the limb toward a bent position. In other embodiments, a brace can be received about the joint of the limb of the patient, the brace engaging the actuation strap when the actuation strap engages the limb of the patient, and the actuation strap can produce a force on the limb via the brace, the force biasing the limb towards a straightened position.

Thus, although there have been described particular embodiments of the present disclosure of a new and useful Joint Rehabilitation Apparatus it is not intended that such references be construed as limitations upon the scope of this disclosure except as set forth in the following claim.

What is claimed is:

1. A rehabilitation apparatus for facilitating joint movement in a patient having a limb with a joint, and an upper torso, the apparatus comprising:

an actuation member;

an actuation strap extending from the actuation member, the actuation member selectively retracting the actuation strap, the actuation strap having a strap end engageable with the limb of the patient; and a harness connected to the actuation member and extending from an opposing side of the actuation member as the actuation strap, the harness receivable about the upper torso of the patient, wherein the actuation member is stabilized on the patient's upper torso when the harness is received about the patient's upper torso;

wherein when the limb of the patient is engaged with the strap end of the actuation strap, the harness is received about the patient's upper torso, and the actuation member retracts the actuation strap, the actuation strap is configured to produce a force on the limb to move the limb at the joint.

2. The apparatus of claim 1, wherein when the harness is received about the patient's upper torso, the limb of the patient is engaged with the strap end of the actuation strap, and the actuation member retracts the actuation strap, the actuation member is retained in a position adjacent the patient's upper torso by the harness.

3. The apparatus of claim 1, wherein the force produced on the limb by the actuation strap is configured to bias the limb toward a bent position.

4. The apparatus of claim 1, wherein the actuation member includes a pawl and ratchet system.

5. The apparatus of claim 1, wherein:

the actuation member has a collection area and a spool located in the collection area; and the actuation strap winds around the spool as the actuation member selectively retracts the actuation strap.

6. The apparatus of claim 1, further comprising:

a brace, the joint of the patient's limb receivable in the brace, the actuation strap positionable on the brace when the patient's joint is received in the brace and the patient's limb is received in the strap end of the actuation strap, wherein the actuation strap is configured to produce a force on the limb via the brace when the actuation member retracts the actuation strap.

7. The apparatus of claim 6, wherein the force produced on the limb via the brace is configured to bias the limb toward a straightened position.

8. The apparatus of claim 6, wherein:

the brace further comprises an extension member oriented to extend from the brace in an outward direction from the limb when the joint of the patient is received by the brace; and the actuation strap is positionable on the extension member when the joint is received by the brace and the limb is received by the strap end of the actuation strap.

9. The apparatus of claim 8, wherein the patient's limb is a leg including a knee joint and a foot, the knee joint is receivable in the brace, the foot is receivable in the strap end of the actuation strap, and the apparatus further comprises: and the actuation strap is configured to produce a downward force on the knee joint via the extension member of the brace when the actuation member retracts the actuation strap, the downward force biasing the leg toward a straightened position.

10. The apparatus of claim 6, wherein the brace includes one or more pads configured to be positioned about the joint of the patient when the brace receives the joint, each pad including a raised central portion, the raised central portion of the pads being spaced from the patient's limb when the patient's limb is received in the brace.

11. The apparatus of claim 1, wherein the actuation strap further includes a plurality of guide markings.

12. The apparatus of claim 1, wherein the actuation member further comprises a release mechanism, the actuation strap extendable from the actuation member when the release mechanism is engaged.

13. The apparatus of claim 1, wherein the limb is a leg of the patient, the leg including a foot, and the apparatus further comprises:

a foot device securable to the foot of the patient, the foot device having a first fastener member extending in a first lateral direction from the foot device, a second fastener member extending in a second lateral direction from the foot device, and a third fastener member extending in a longitudinally outward direction from the foot device; and the actuation strap is engageable with the first, second, or third fastener members on the foot device when the foot device is secured to the foot of the patient.

14. The apparatus of claim 1, wherein the actuation strap is oriented in a double strap configuration, with both ends of the actuation strap connected to and retractable by the actuation member to form a continuous loop extending from the actuation member, the loop including an apex, the strap end of the actuation strap located at the apex, the loop sized to receive the joint of the patient's limb when the patient's limb is engaged with the strap end of the loop.

15. A rehabilitation apparatus for facilitating joint movement in a patient having a limb with a joint and an upper torso, the apparatus comprising:

an actuation member;

an actuation strap extending from the actuation member, the actuation member selectively retracting the actuation strap, the actuation strap having a strap end engageable with the limb of the patient;

a security strap connected to the actuation member and extending from the actuation member in an opposite direction from the actuation strap, the security strap receivable about the patient's upper torso; and a brace positionable about the joint of the patient's limb, the brace including an extension member extending outward from the brace;

wherein when the limb of the patient is engaged with the strap end of the actuation strap, the security strap is received about the patient's upper torso, the brace is positioned about the joint of the patient's limb, and the actuation member retracts the actuation strap, the actuation strap is configured to engage the extension member of the brace to produce a force on the limb.

16. The apparatus of claim 15, wherein the security strap stabilizes the actuation member on the patient's upper torso as the actuation member retracts the actuation strap.

17. The apparatus of claim 16, wherein:

the extension member is engageable with the actuation strap at a point on the actuation strap between the strap end and the actuation member when the brace is positioned on the joint and the strap end engages the limb;

the extension member produces an angle between 0 and 180 degrees in the actuation strap as the actuation member retracts the actuation strap; and the actuation strap produces a force on the limb via the extension member of the brace when the actuation member retracts the actuation strap, the force biasing the limb towards a straightened position.

18. A rehabilitation apparatus for facilitating joint movement in a patient having a limb with a joint, the apparatus comprising:

an actuation member having a collection area;

an actuation strap extending from the actuation member, the actuation member selectively retracting the actuation strap into the collection area, the actuation strap having opposite ends connected to the actuation member such that the actuation strap forms a continuous loop extending from the actuation member, the actuation strap forming an apex engageable with the limb of the patient; and a security strap connected to the actuation member and extending from the actuation member in a direction opposite from the actuation strap;

wherein when the limb of the patient is engaged with the strap end of the actuation strap and the actuation member retracts the actuation strap, the actuation strap is configured to produce a force on the limb.

19. The apparatus of claim 18, wherein the actuation member includes an outer housing, and the collection area is at least partially defined within the outer housing.

20. The apparatus of claim 18, wherein the force produced on the limb is configured to bias the limb to move at the joint.

* * * * *